US007399206B2

(12) United States Patent
Tsao

(10) Patent No.: US 7,399,206 B2
(45) Date of Patent: Jul. 15, 2008

(54) COAXIAL CONNECTOR

(75) Inventor: Jung-Tsung Tsao, Shu Lin (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/145,139

(22) Filed: Jun. 3, 2005

(65) Prior Publication Data

US 2005/0272310 A1 Dec. 8, 2005

(30) Foreign Application Priority Data

Jun. 4, 2004 (TW) ..... 93208886 U

(51) Int. Cl.
*H01R 9/05* (2006.01)

(52) U.S. Cl. ..... 439/578; 439/63

(58) Field of Classification Search ..... 439/578, 439/63

See application file for complete search history.

(56) References Cited

U.S. PATENT DOCUMENTS 2,757,351 A * 7/1956 Klostermann ..... 439/583
3,525,973 A * 8/1970 Kipnes ..... 439/578
3,663,901 A * 5/1972 Forney, Jr. ..... 439/585
4,650,271 A * 3/1987 Forney et al. ..... 439/578
5,021,001 A * 6/1991 Ramirez ..... 439/578
5,041,020 A * 8/1991 Michael ..... 439/578
5,217,391 A * 6/1993 Fisher, Jr. ..... 439/578
5,327,111 A * 7/1994 Gipprich ..... 439/578
5,525,076 A * 6/1996 Down ..... 439/585
5,620,339 A * 4/1997 Gray et al. ..... 439/578
6,146,196 A * 11/2000 Burger et al. ..... 439/578
6,926,555 B2 * 8/2005 Nelson ..... 439/578

* cited by examiner

*Primary Examiner*—Briggitte R Hammond
(74) *Attorney, Agent, or Firm*—Robert J. Zeitler

(57) ABSTRACT

A coaxial connector for connection with a coaxial cable has an insulative sleeve, a connection member, and a conductive terminal. The connection member is a tubular conductive structure. The insulative sleeve is positioned in the connection member. The connection member has an inscribed surface formed at a rear end thereof. The conductive terminal has a positioning recess formed at a rear end thereof for soldering with a core of the coaxial cable. A conductive layer of the coaxial cable is penetrated into the rear end of the connection member and is adjacent to the inscribed surface for soldering with the connection member. Therefore, the connection between the coaxial cable and the coaxial connector is easy, and the position of the coaxial cable is accurate. Moreover, because it is not necessary to spread the conductive layer of the coaxial cable, it maintains a better electrical property, so as to have a broad application, a wide range of frequency, and a high stability and small loss of signals thereof.

15 Claims, 10 Drawing Sheets

COAXIAL CONNECTOR

FIELD OF THE INVENTION

The present invention relates to a coaxial connector, and more particularly, to a coaxial connector that is easy to connect with a coaxial cable.

BACKGROUND OF THE INVENTION

It is well known that coaxial cables are commonly used in communication equipment. The trend of development of both hardware and software of electronic products, such as notebook computers, is to combine the notebook computers with mobile communication functions. A coaxial cable is applied to connect with a built-in antenna to a communication module on a printed circuit board of a notebook. A distal end of the coaxial cable connects to a mating connector of the communication module or a mating connector disposed at a distal end of another coaxial cable by using a coaxial connector.

Referring to FIG. 1 and FIG. 2, a conventional coaxial connector (such as MicroMate Coax Connector, MMCX) is for connection with a coaxial cable 5. The coaxial cable 5 has a core 50, an inner insulative layer 51, a conductive layer 52, and an outer insluative layer 53 arranged from an inside thereof to an outside thereof in order. The conductive layer 52 is a metal braid. The coaxial connector includes an insulative sleeve 6, a connection member, and a conductive terminal 4. The connection member is a tubular conductive structure and has a body element 7, an extension element 8, and a resilient snap-ring 9. The body element 7 has a front opening 70 and a rear opening 71 respectively formed at a front end thereof and a rear end thereof. The insulative sleeve 6 is installed in the body element 7 through the rear opening 71. The extension element 8 has a front end connecting in the rear opening 71 of the body element 7 and positioning the insulative sleeve 6 in the connection member. The extension element 8 has a circumscribed surface 80 disposed at an outer surface of a rear end thereof. The resilient snap-ring 9 snaps around an outer circumferential surface of the front end of the body element 7. The conductive terminal 4 is a male terminal and has a positioning recess 411 formed at a rear end thereof.

When the coaxial cable 5 is connected with the coaxial connector, first, a rivet element 57 is disposed around the coaxial cable 5, and a distal end of the coaxial cable 5 is stripped to expose the core 50, the inner insulative layer 51, and the conductive layer 52. Next, the core 50 of the coaxial cable 5 is penetrated into the positioning recess 411 and is soldered on the conductive terminal 4, and the conductive layer 52 is spread. Further, a front end of the conductive terminal 4 is penetrated through the extension element 8, the inner insulative layer 51 is located in the extension element 8, and the conductive layer 52 of the coaxial cable 5 envelops the circumscribed surface 80 of the extension element 8. Further, the front end of the conductive terminal 4 is penetrated through the insulative sleeve 6 to a front end of the connection member, and a front end of the extension element 8 is connected in the rear opening 71 of the body element 7. Finally, the rivet element 57 is disposed outside the conductive layer 52, and a set of hexagonal molds is applied to rivet the rivet element 57, so as to fix the conductive layer 52 on the extension element 8 of the connection member.

According to the conventional coaxial connector, first, because the conductive layer 52 is spread, a specific electrical property is formed, and the coaxial connector can only be applied to one type of an outer diameter of the coaxial cable and the range of frequency is only in DC-6 Ghz. Second, the conductive layer 52 is spread, so the stability thereof is impacted and it causes loss of signals thereof. Third, it is time-consuming and hard to position to spread the conductive layer 52 and to dispose the conductive terminal 4. Moreover, when the set of hexagonal molds rivets the rivet element 57, a shearing force is produced to push the conductive terminal 4 backwardly. As a result, the position of the conductive terminal 4 is not accurate.

FIG. 3 and FIG. 4 show another conventional coaxial connector which is a mating connector of the coaxial connector described in FIG. 1 and FIG. 2. The way to connect the coaxial connector in FIG. 3 and FIG. 4 with the coaxial cable 5 is the same as above. The differences of the structure are that the conductive terminal 4' is a female terminal, and the body element 7' has a front opening 70' formed at a front end thereof and an inner groove 72'. When the above two coaxial connectors are mated with each other, the resilient snap-ring 9 is locked in the inner groove 72' to ensure the mating stability. Though it reaches the required stability, the insertion or pulling force of the mating or detachment thereof is above 10 pounds, which is hard to do by hands.

Accordingly, as discussed above, the conventional coaxial connector still has some drawbacks that could be improved. The present invention aims to resolve the drawbacks in the prior art.

SUMMARY OF THE INVENTION

The primary object of the invention is therefore to specify a coaxial connector, so that the connection between the coaxial connector and a coaxial cable is easy.

Another object of the invention is therefore to specify a coaxial connector, so as to have a broad application, a wide range of frequency, and a high stability and small loss of signals thereof.

Still other object of the invention is therefore to specify a coaxial connector, so that the mating between the coaxial connector and a mating coaxial connector is secure and an insertion or pulling force thereof is small.

According to the invention, the object is achieved via a coaxial connector for connection with a coaxial cable. The coaxial cable has a core, an inner insulative layer, a conductive layer, and an outer insluative layer arranged from an inside thereof to an outside thereof in order The coaxial connector comprises an insulative sleeve, a connection member, and a conductive terminal. The insulative sleeve has an aperture. The connection member is a tubular conductive structure. The insulative sleeve is positioned in the connection member. The connection member has an inscribed surface formed at a rear end thereof. The conductive terminal has a positioning recess formed at a rear end thereof. The core of the coaxial cable is penetrated into the positioning recess and is soldered on the conductive terminal. The conductive terminal has a front end being penetrated through the aperture of the insulative sleeve to a front end of the connection member. The conductive layer of the coaxial cable is penetrated into the rear end of the connection member and is adjacent to the inscribed surface. The conductive layer is soldered with the connection member.

The conductive layer of the coaxial cable is penetrated directly through the rear end of the connection member and is adjacent to the inscribed surface for soldering, so that the connection between the coaxial connector and the coaxial cable is easy, and the position of the coaxial cable is accurate. Moreover, because it is not necessary to spread the conductive layer of the coaxial cable, it maintains a better electrical property, so as to have a broad application, a wide range of frequency, and a high stability and small loss of signals thereof.

Furthermore, the resilient element of the connection member of the coaxial connector can contract or expand, so that the mating between the resilient element and a mating coaxial connector is firmly and an insertion or pulling force thereof is small.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
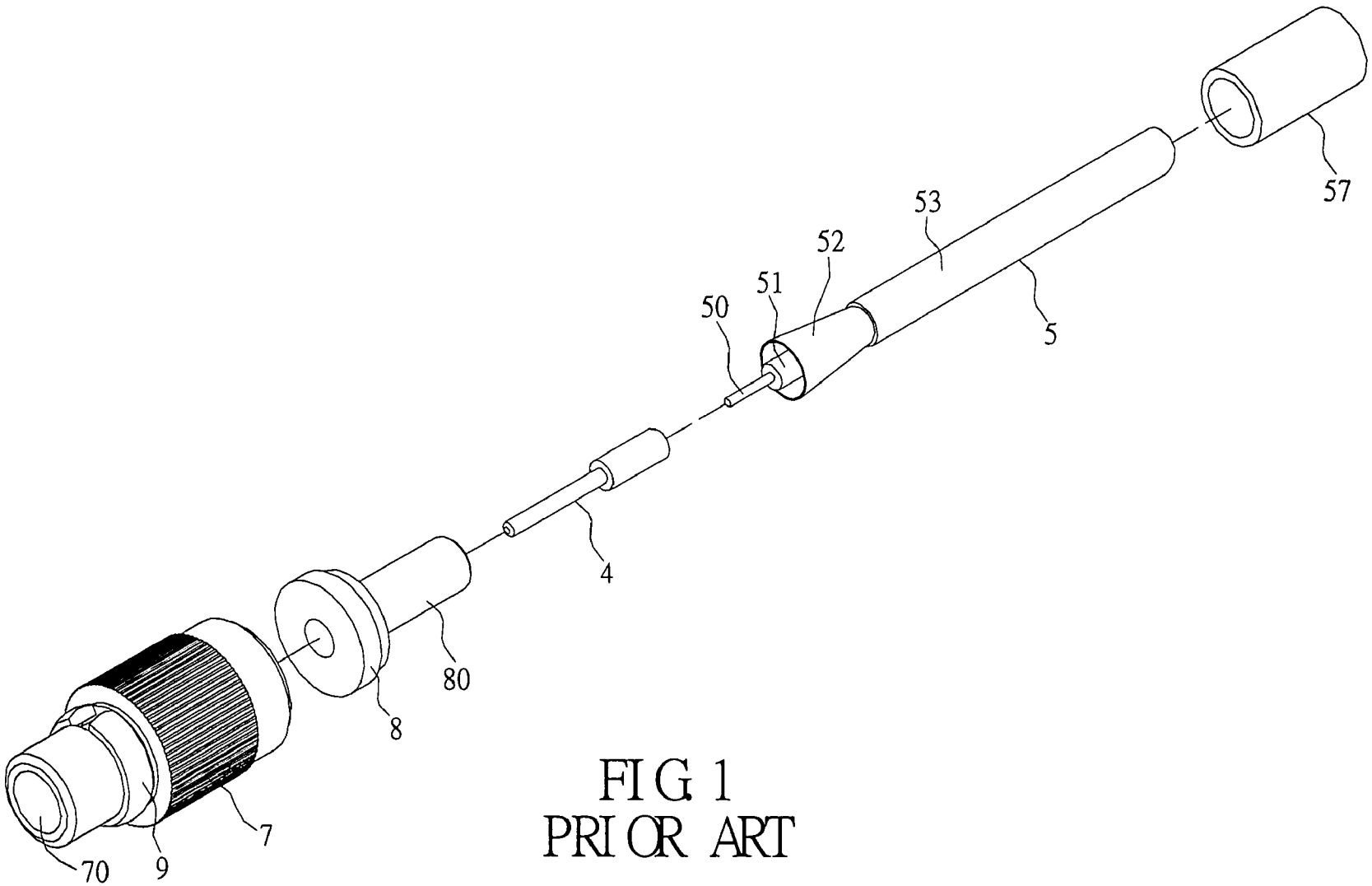
FIG 1 PRIOR ART
FIG. 1 is an exploded perspective view of a coaxial connector of the prior art prior to connection with a coaxial cable.
Figure 2:
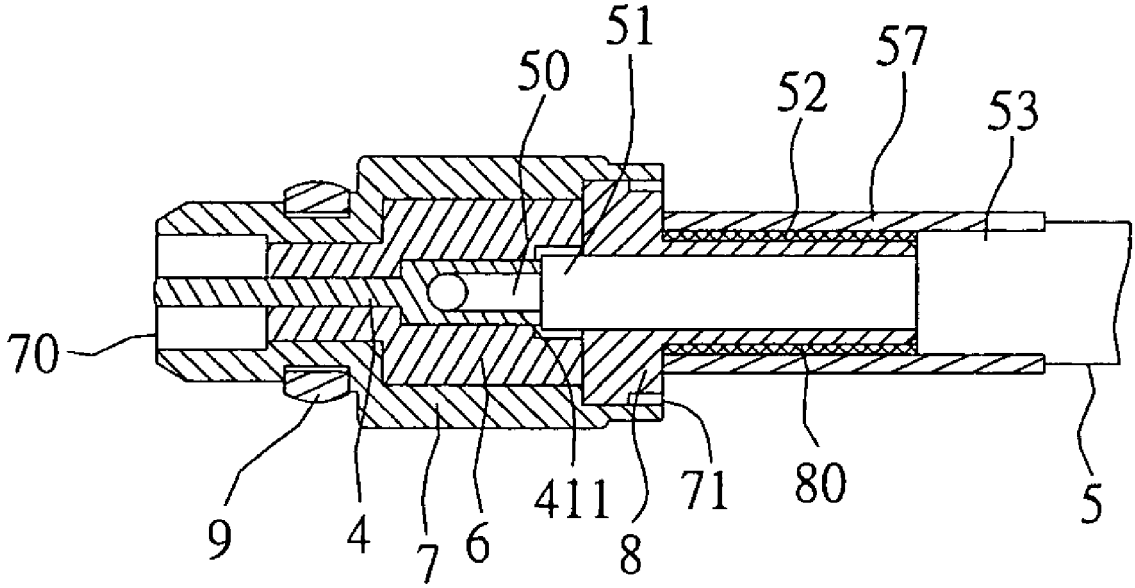
FIG. 2 PRIOR ART
FIG. 2 is a cross-sectional view of a coaxial connector of the prior art when connection with a coaxial cable.
Figure 3:
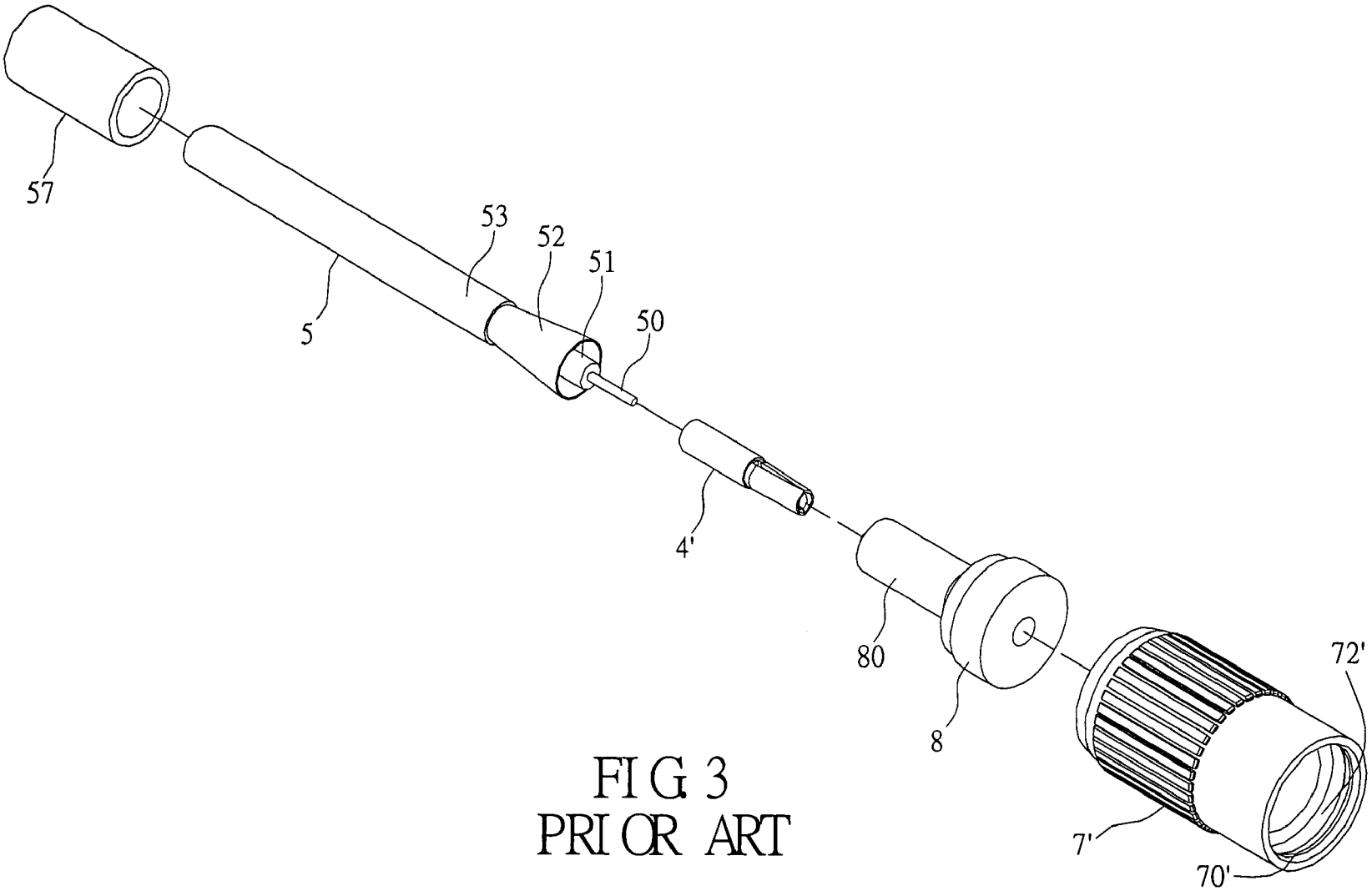
FIG 3 PRIOR ART
FIG. 3 is an exploded perspective view of another coaxial connector of the prior art prior to connection with a coaxial cable.
Figure 4:
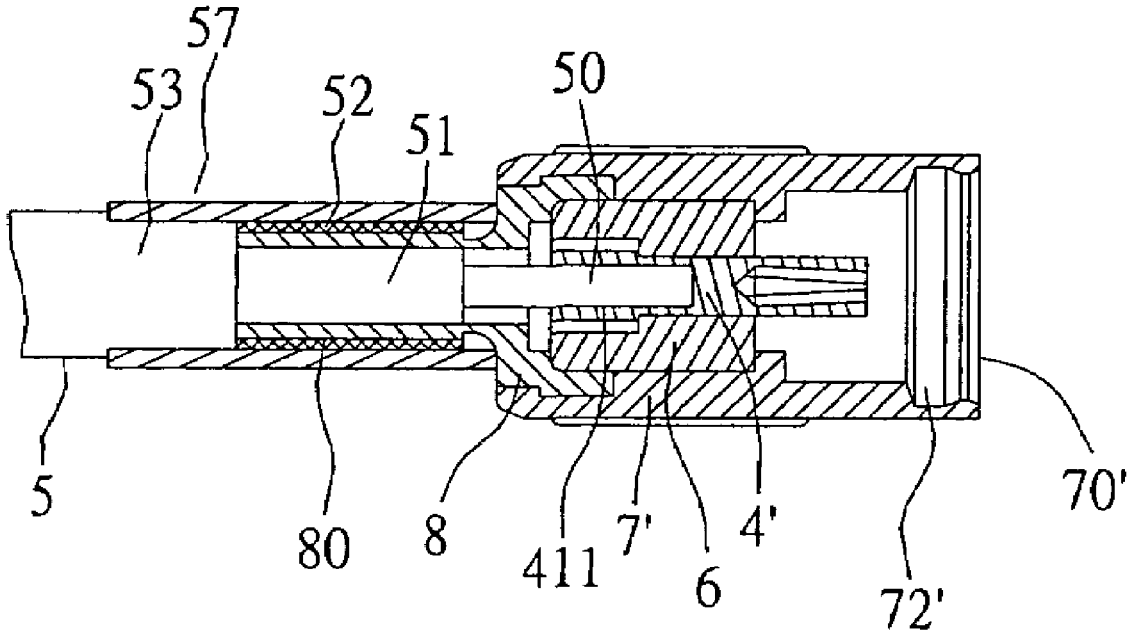
FIG 4 PRIOR ART
FIG. 4 is a cross-sectional view of another coaxial connector of the prior art when connection with a coaxial cable.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 5:
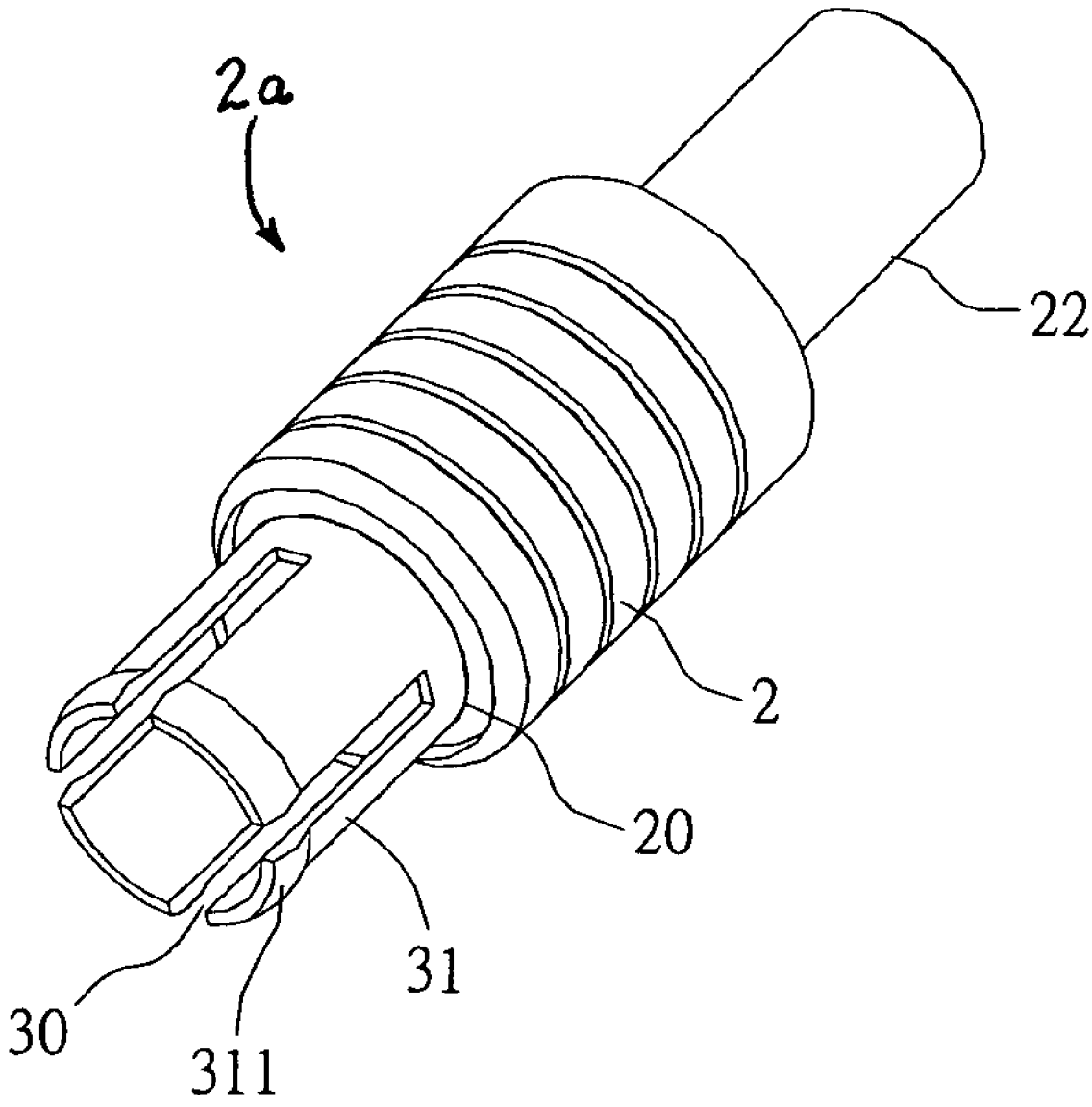
FIG. 5 is a perspective view of a first embodiment of a coaxial connector of the present invention.
Figure 6:
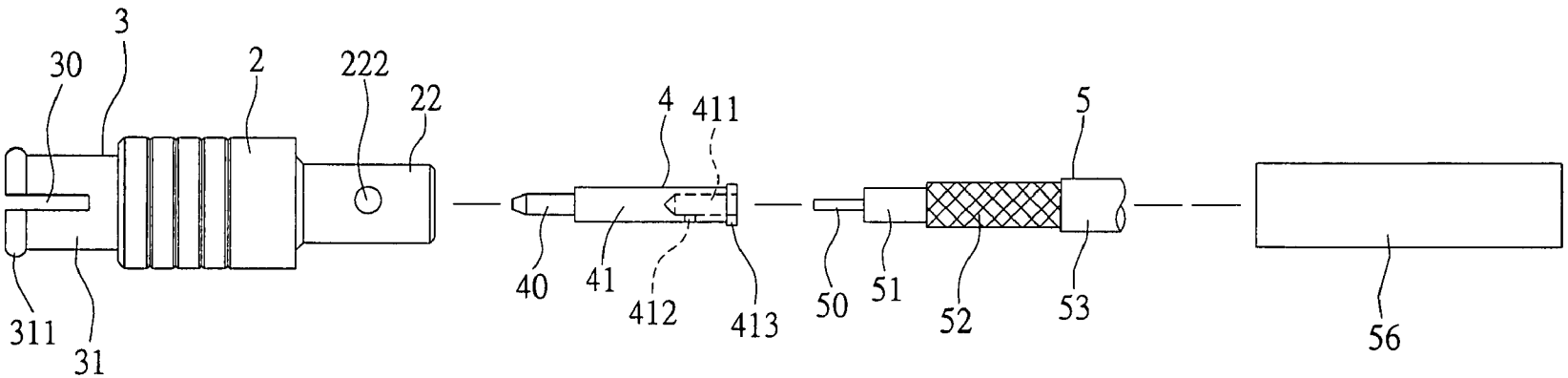
FIG. 6 is an exploded partial planar view of a first embodiment of a coaxial connector of the present invention prior to connection with a coaxial cable.
Figure 7:
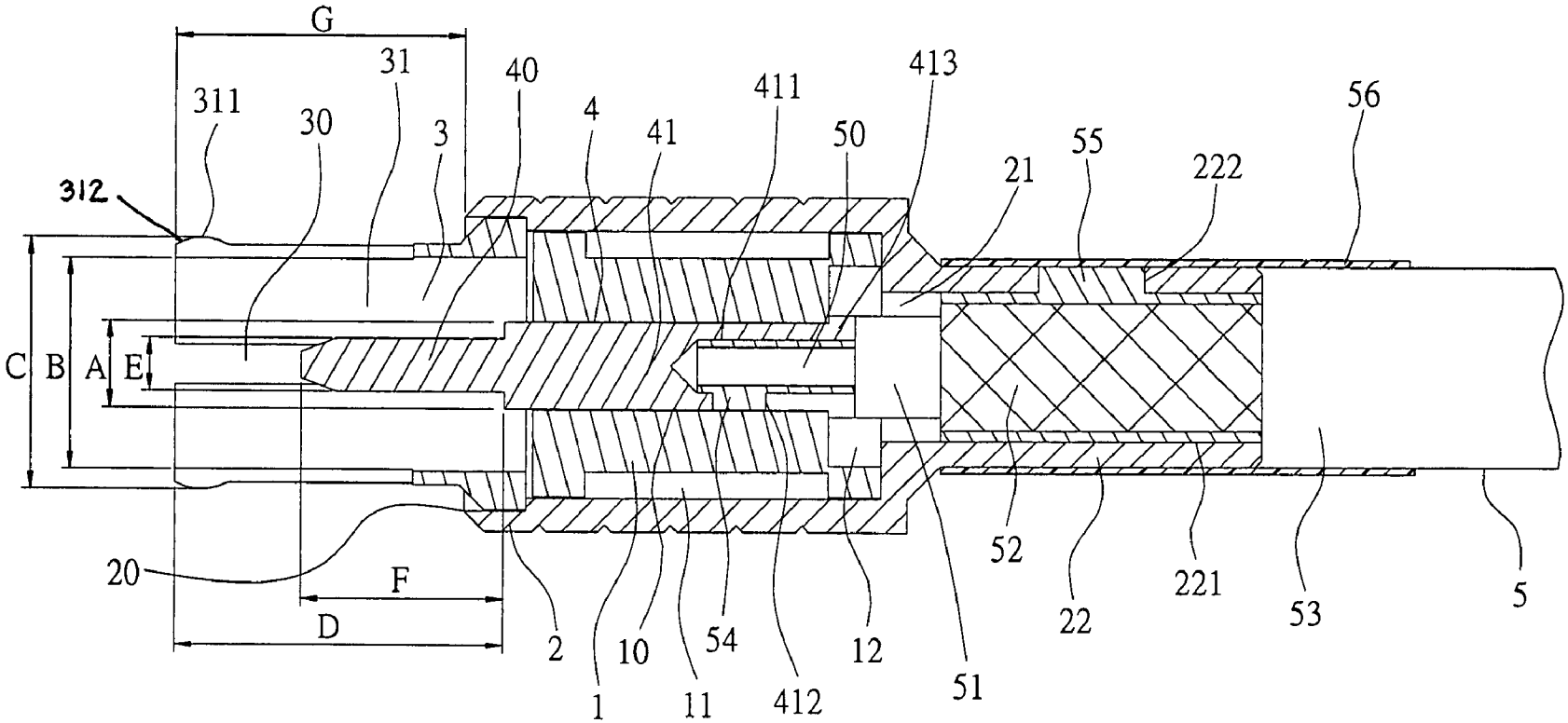
FIG. 7 is a cross-sectional view of a first embodiment of a coaxial connector of the present invention when connection with a coaxial cable.

FIGS. 5-7 show a first embodiment of the present invention. The present invention provides a coaxial connector for connection with a coaxial cable 5. The coaxial cable 5 has a core 50, an inner insulative layer 51, a conductive layer 52, and an outer insluative layer 53 arranged from an inside thereof to an outside thereof in order. The conductive layer 52 can be a metal braid. The coaxial connector comprises an insulative sleeve 1, a connection member 2*a*, and a conductive terminal 4.

The insulative sleeve 1 is substantially a cylinder. The insulative sleeve 1 has an aperture 10. The insulative sleeve 1 has an annular groove 11 formed on an outer circumferential surface thereof. The insulative sleeve 1 has a concavity 12 formed at a rear end thereof.

The connection member is a tubular conductive structure. The connection member has an inscribed surface 221 formed at a rear end thereof. In this embodiment, the connection member includes a body element 2 and a resilient element 3. The body element 2 has a front opening 20 and a rear opening 21 respectively formed at a front end thereof and a rear end thereof. The body element 2 has an extension portion 22 with a reduced diameter and extending from the rear end thereof. The inscribed surface 221 is an inner surface of the extension portion 22, and the extension portion 22 has a through hole 222 communicating to the inscribed surface 221. The insulative sleeve 1 is installed into the body element 2 through the front opening 20 and is blocked by the extension portion 22. There is air inside the annular groove 11 and the concavity 12 to reduce a dielectric constant thereof. The resilient element 3 has slits 30 formed at a front end thereof to form resilient arms 31. Each of the resilient arms 31 has an outer flange 311 disposed at a free end thereof. Each of the outer flanges 311 has a guiding angle. The resilient element 3 has a rear end accommodating to the front opening 20 of the body element 2 and connecting in the front opening 20 of the body element 2 by riveting and positioning the insulative sleeve 1 in the connection member.

The conductive terminal 4 has a positioning recess 411 formed at a rear end thereof. In this embodiment, the conductive terminal 4 is a male terminal. The conductive terminal 4 has a contact portion 40 and an installation portion 41. The contact portion 40 integrally extends from a front end of the installation portion 41. The positioning recess 411 is formed at a rear end of the installation portion 41. The installation portion 41 has a through hole 412 communicating to the positioning recess 411. The installation portion 41 has an outer stop edge 413 disposed at a rear end thereof. The installation portion 41 has an outer diameter accommodating to an inner diameter of the aperture 10 of the insulative sleeve 1. The contact portion 40 is located at the front end of the connection member. The outer stop edge 413 is blocked outside the aperture 10.

When the coaxial cable 5 is connected with the coaxial connector, first, a distal end of the coaxial cable 5 is stripped to expose the core 50, the inner insulative layer 51, and the conductive layer 52. Next, the core 50 of the coaxial cable 5 is penetrated into the positioning recess 411 of the conductive terminal 4, and a solder 54 solders the core 50 of the coaxial cable 5 in the positioning recess 411 via the through hole 412 of the installation portion 41, so that the core 50 is soldered on the conductive terminal 4. Further, the contact portion 40 at a front end of the conductive terminal 4 is penetrated through the extension portion 22 of the body element 2 and the aperture 10 of the insulative sleeve 1 to the resilient element 3 at a front end of the connection member, such that the outer diameter of the installation portion 41 accommodates to the inner diameter of the aperture 10 of the insulative sleeve 1, the contact portion 40 is positioned at the front end of the connection member, and the outer stop edge 413 is blocked outside the aperture 10. The conductive layer 52 of the coaxial cable 5 is penetrated into the rear end of the connection member and is adjacent to the inscribed surface 221 of the extension portion 22 of the body element 2, and a solder 55 solders the conductive layer 52 of the coaxial cable 5 on the inscribed surface 221 via the through hole 222 of the extension portion 22, so that the conductive layer 52 is soldered with the connection member.

Because soldering replaces conventional riveting by a set of hexagonal molds, the connection between the coaxial connector and the coaxial cable 5 is easy, the position of the coaxial cable 5 is accurate, the number of elements is reduced, and the cost thereof is reduced. Moreover, because it is not necessary to spread the conductive layer 52 of the coaxial cable 5, it maintains a better electrical property, so as to have a broad application of connection of more than five types of diameters of coaxial cables, a wide range of frequency of reaching DC-10 Ghz, and a high stability and small loss of signals thereof.

Furthermore, prior to connection between the coaxial cable 5 and the coaxial connector, a heat-shrinkable tube 56 can be disposed outside the coaxial cable 5. When the above connection is complete, the extension portion 22 of the body element 2 at the rear end of the connection member and a corresponding adjacent distal end of the outer insulative layer 53 of the coaxial cable 5 are enveloped in the heat-shrinkable tube 56, so that the soldering between the extension portion 22 and the conductive layer 52 is further protected, fixed and insulated.

Figure 8:
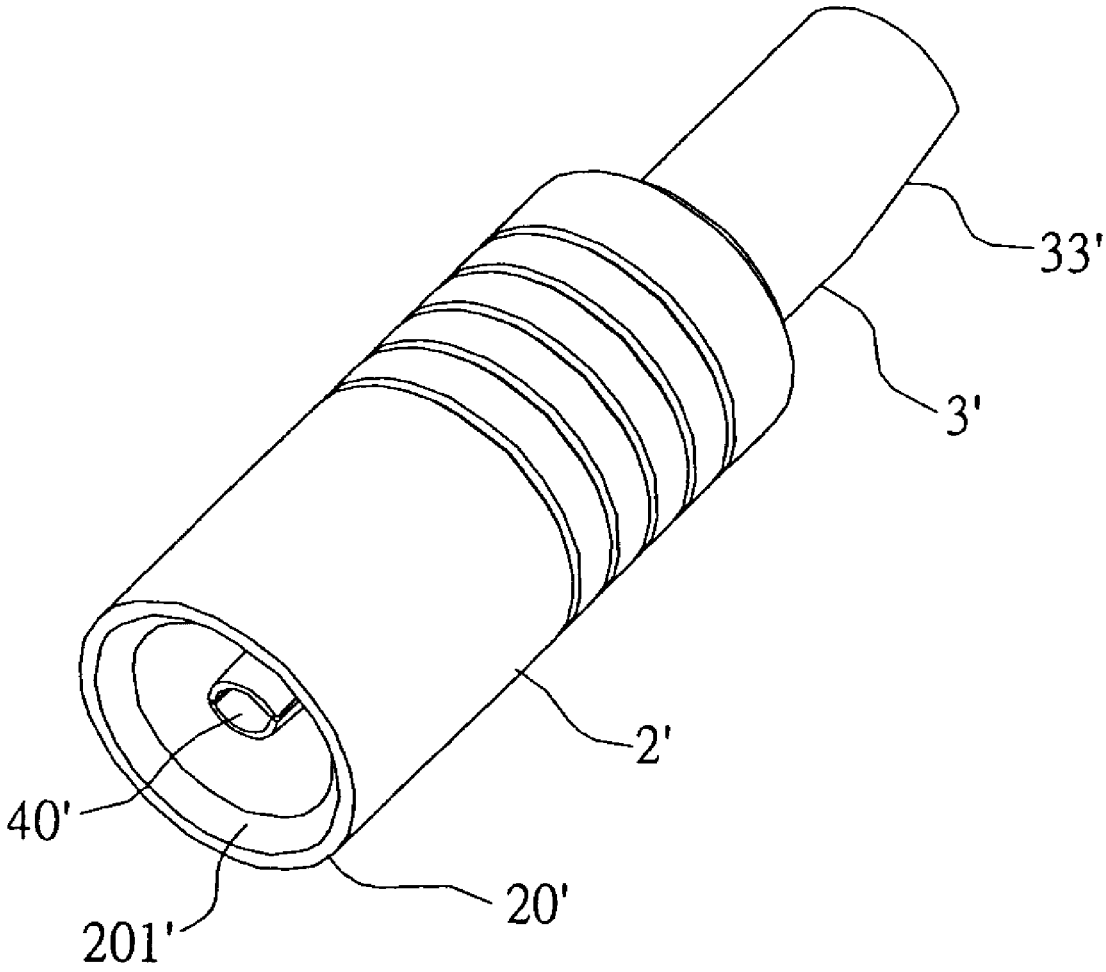
FIG. 8 is a perspective view of a second embodiment of a coaxial connector of the present invention.
Figure 9:
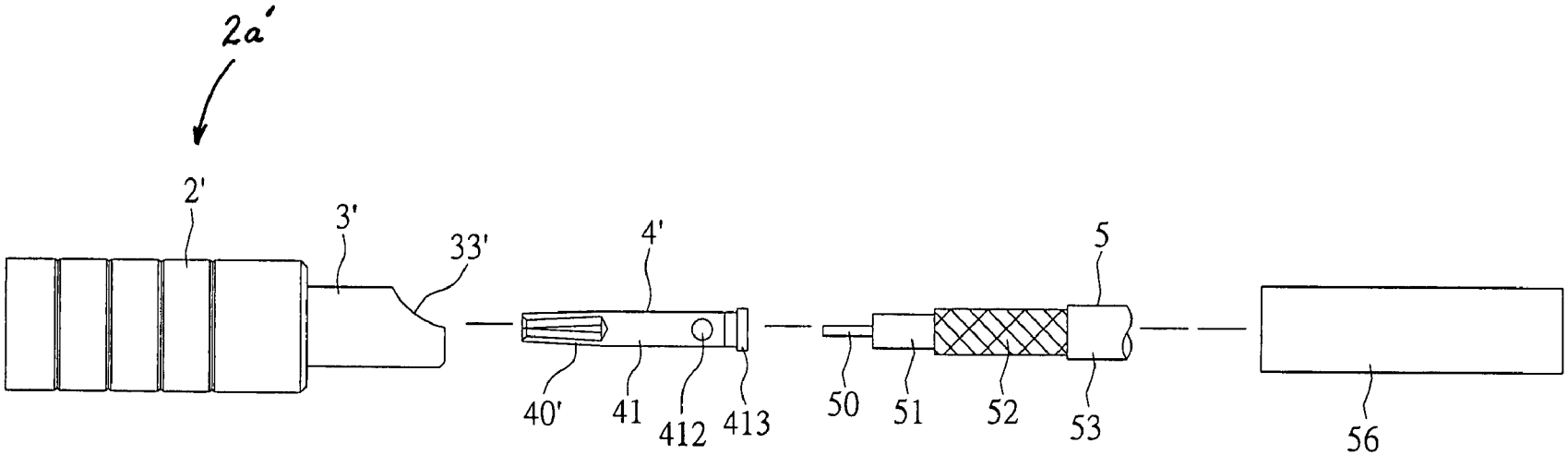
FIG. 9 is an exploded partial planar view of a second embodiment of a coaxial connector of the present invention prior to connection with a coaxial cable.
Figure 10:
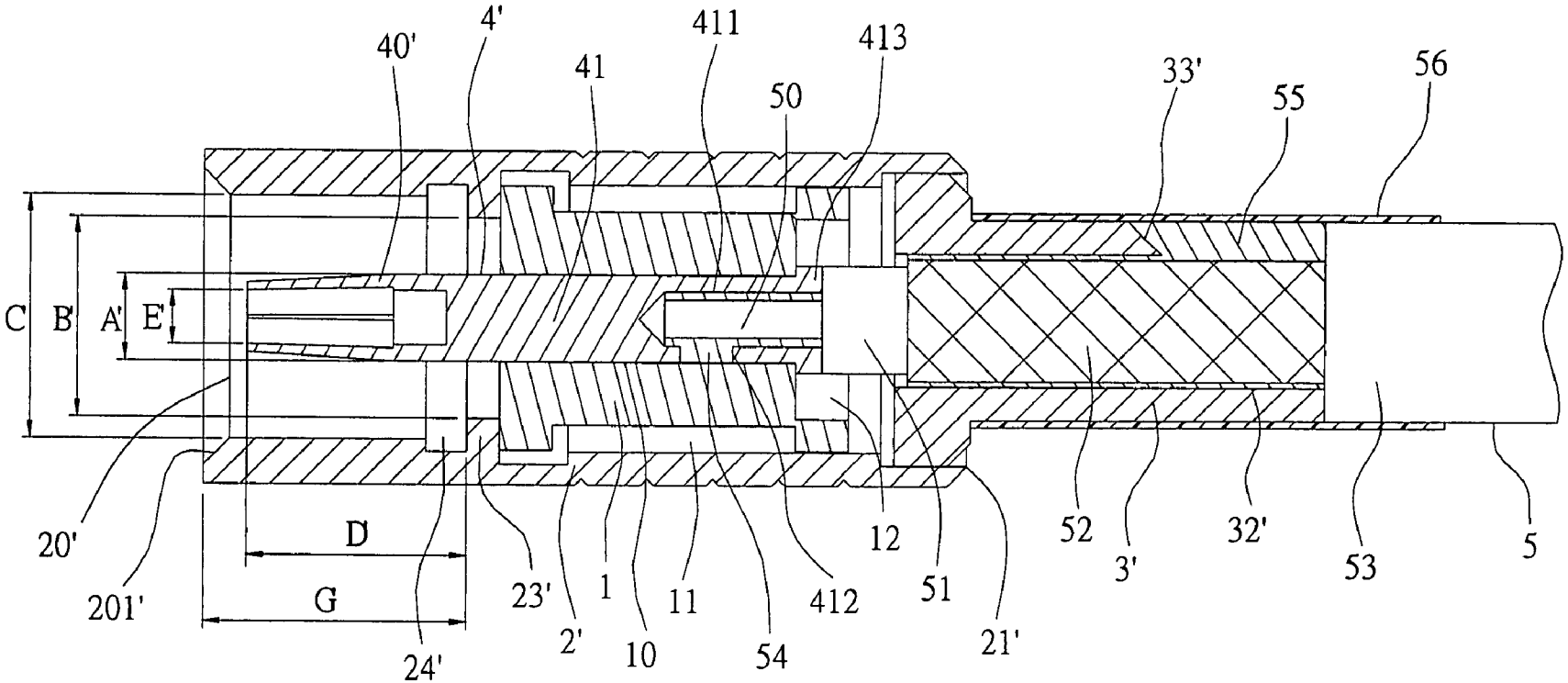
FIG. 10 is a cross-sectional view of a second embodiment of a coaxial connector of the present invention when connection with a coaxial cable.

FIGS. 8-10 show a second embodiment of the present invention. The second embodiment is a mating connector of the coaxial connector of the first embodiment. The coaxial connector of the second embodiment comprises an insulative sleeve 1, a connection member 2*a*', and a conductive terminal 4'. The insulative sleeve 1 is the same as that of the first embodiment. The conductive terminal 4' is a female terminal, and the contact portion 40' thereof is different from the contact portion 40 of the first embodiment. The connection member is a tubular conductive structure. The connection member has an inscribed surface 32' formed at a rear end thereof. In this embodiment, the connection member includes a body element 2' and an extension element 3'. The body element 2' has a front opening 20' and a rear opening 21' respectively formed at a front end thereof and a rear end thereof. The body element 2' has a guiding slant 201' disposed at the front opening 20' for guiding the guiding angles 312 of the resilient arms of the first embodiment thereinto. The body element 2' has an inner stop edge 23' disposed at an inner surface thereof. The body element 2' has an inner groove 24' formed on the inner surface of the body element 2' and between the front opening 20' and the inner stop edge 23'. The insulative sleeve 1 is installed in the body element 2' through the rear opening 21' and is blocked by the inner stop edge 23'. The inscribed surface 32' is an inner surface of the extension element 3', and the extension element 3' has a soldering opening 33' formed at a rear end thereof. The soldering opening 33' can be a hole or a cutout. The extension element 3' has a front end accommodating to the rear opening 21' of the body element 2' and connecting in the rear opening 21' of the body element 2' by riveting and positioning the insulative sleeve 1 in the connection member.

The connection between the coaxial cable 5 and the coaxial connector of the second embodiment is like that of the first embodiment. The core 50 is soldered on the conductive terminal 4'. The contact portion 40' at a front end of the conductive terminal 4' is penetrated through the extension element 3' and the aperture 10 of the insulative sleeve 1 to the body element 2' at a front end of the connection member. The conductive layer 52 of the coaxial cable is penetrated into the rear end of the connection member and is adjacent to the inscribed surface 32' of the extension element 3', and a solder 55 solders the conductive layer 52 of the coaxial cable 5 on the inscribed surface 32' via the soldering opening 33' of the extension element 3', so that the conductive layer 52 is soldered with the connection member.

When the coaxial connector of the first embodiment mates with the coaxial connector of the second embodiment, the outer flanges 311 of the resilient element 3 of the connection member of the first embodiment are positioned in the inner groove 24' of the body element 2' of the connection member of the second embodiment, such that the conductive terminal 4 (male terminal) of the first embodiment firmly connects with the conductive terminal 4' (female terminal) of the second embodiment. Because the resilient element 3 can contract or expand, the mating between the above two coaxial connectors is firmly and an insertion or pulling force thereof is small. The conductive terminal 4 of the first embodiment may be a female terminal, and the conductive terminal 4' of the second embodiment may be a male terminal.

FIG. 7 and FIG. 10 show preferable embodiments of dimensions of the coaxial connectors of the present invention. Referring to FIG. 7, the contact portion 40 of the conductive terminal 4 has an outer diameter E between 0.3 and 0.43 millimeter. The installation portion 41 of the conductive terminal 4 has an outer diameter A between 0.6 and 0.65 millimeter. The contact portion 40 of the conductive terminal 4 has a length F of 1.2 millimeter. The resilient element 3 has an inner diameter B at the resilient arms 31 between 1.4 and 1.5 millimeter. The resilient element 3 has an outer diameter C at the outer flanges 311 of the resilient arms 31 between 1.7 and 2.1 millimeter. A distance D between the outer flanges 311 of the resilient arms 31 of the resilient element 3 and the front end of the installation portion 41 of the conductive terminal 4 is 3.81 millimeter. The resilient element 3 has a maximum length G of 2.19 millimeter at the front end thereof and extending out of the body element 2. Referring to FIG. 10, the contact portion 40' of the conductive terminal 4' has an opening dimension E' between 0.318 and 0.35 millimeter. The installation portion 41 of the conductive terminal 4' has an outer diameter A' between 0.6 and 0.65 millimeter. The inner stop edge 23' of the body element 2' has an inner diameter B' between 1.4 and 1.5 millimeter. The front opening 20' of the body element 2' has an inner diameter C' between 2.0 and 2.125 millimeter. A maximum distance G' between the front opening 20' of the body element 2' and the inner stop edge 23' of the body element 2' is 2.19 millimeter. A distance D' between the front end of the contact portion 40' of the conductive terminal 4' and the inner stop edge 23' of the body element 2' is between 1.1 and 1.42 millimeter. Of course, the above dimensions are not to be construed as a limitation of the present invention.

As indicated above, the coaxial connector of the present invention has the following advantages:

(1) The conductive layer of the coaxial cable is penetrated directly through the rear end of the connection member and is adjacent to the inscribed surface for soldering, so that the connection of the coaxial connector and the coaxial cable is easy, and the position of the coaxial cable is accurate. Moreover, because it is not necessary to spread the conductive layer of the coaxial cable, it maintains a better electrical property, so as to have a broad application, a wide range of frequency, and a high stability and small loss of signals thereof.

(2) The resilient element of the connection member can contract or expand, so that the mating between the resilient element and a mating coaxial connector is firmly and an insertion or pulling force thereof is small.

While preferred embodiments of the present invention are shown and described, it is envisioned that those skilled in the art may devise various modifications of the present invention without departing from the spirit and scope of the appended claims.

What is claimed is:

1. A coaxial connector for connection with a coaxial cable, the coaxial cable having a core, an inner insulative layer, a conductive layer, and an outer insulative layer arranged from an inside thereof to an outside thereof in order, the coaxial connector comprising:

an insulative sleeve having an aperture;

a connection member comprising a conductive structure having an inner surface;

the insulative sleeve being positioned in the connection member; and a conductive terminal having a positioning recess formed at a rear end thereof, the core of the coaxial cable being penetrated into the positioning recess and being soldered on the conductive terminal, the conductive terminal having a front end being penetrated through the aperture of the insulative sleeve to a front end of the connection member, the conductive layer of the coaxial cable being penetrated into the rear end of the connection member and being adjacent to the inner surface, and the conductive layer being soldered with the connection member;

wherein the connection member includes a body element and a resilient element, the body element having a front opening formed at a front end thereof, the body element having an extension portion with a reduced diameter and extending from a rear end thereof, the insulative sleeve being installed into the body element through the front opening and being blocked by the extension portion, the resilient element having a rear end connecting in the front opening of the body element and positioning the insulative sleeve in the connection member, the inner surface being an inner surface of the extension portion, the extension portion having a through hole communicating to the inner surface, and a solder soldering the conductive layer of the coaxial cable on the inner surface via the through hole.

2. The coaxial connector as claimed in claim 1, wherein the resilient element has slits formed at a front end thereof to form resilient arms, and each of the resilient arms has an outer flange disposed at a free end thereof.

3. The coaxial connector as claimed in claim 2, wherein each of the outer flanges of the resilient element has a guiding angle.

4. The coaxial connector as claimed in claim 2, wherein the conductive terminal is a male terminal having a contact portion and an installation portion, the contact portion integrally extending from a front end of the installation portion, wherein the contact portion of the conductive terminal has an outer diameter between 0.3 and 0.43 millimeter, the installation portion of the conductive terminal has an outer diameter between 0.6 and 0.65 millimeter, the contact portion of the conductive terminal has a length of 1.2 millimeter, the resilient element has an inner diameter at the resilient arms between 1.4 and 1.5 millimeter, the resilient element has an outer diameter at the outer flanges of the resilient arms between 1.7 and 2.1 millimeter, a distance between the outer flanges of the resilient arms of the resilient element and the front end of the installation portion of the conductive terminal is 3.81 millimeter, and the resilient element has a maximum length of 2.19 millimeter at the front end thereof and extending out of the body element.

5. A coaxial connector for connection with a coaxial cable, the coaxial cable having a core, an inner insulative layer, a conductive layer, and an outer insulative layer arranged from an inside thereof to an outside thereof in order, the coaxial connector comprising:

an insulative sleeve having an aperture;

a connection member comprising a conductive structure having an inner surface;

the insulative sleeve being positioned in the connection member; and a conductive terminal having a positioning recess formed at a rear end thereof, the core of the coaxial cable being penetrated into the positioning recess and being soldered on the conductive terminal, the conductive terminal having a front end being penetrated through the aperture of the insulative sleeve to a front end of the connection member, the conductive layer of the coaxial cable being penetrated into the rear end of the connection member and being adjacent to the inner surface, and the conductive layer being soldered with the connection member;

wherein the connection member includes a body element and an extension element, the body element having a rear opening formed at a rear end thereof, the body element having an inner stop edge disposed at an inner surface thereof, the insulative sleeve being installed in the body element through the rear opening and being blocked by the inner stop edge, the extension element having a front end connecting in the rear opening of the body element and positioning the insulative sleeve in the connection member, the inner surface being an inner surface of the extension element, the extension element having a soldering opening formed at a rear end thereof, and a solder soldering the conductive layer of the coaxial cable on the inner surface via the soldering opening.

6. The coaxial connector as claimed in claim 5, wherein the body element has a front opening formed at a front end thereof, and the body element has an inner groove formed on the inner surface of the body element and between the front opening and the inner stop edge.

7. The coaxial connector as claimed in claim 6, wherein the body element has a guiding slant disposed at the front opening thereof.

8. The coaxial connector as claimed in claim 6, wherein the conductive terminal is a female terminal having a contact portion and an installation portion, the contact portion integrally extending from a front end of the installation portion, wherein the contact portion of the conductive terminal has an opening dimension between 0.318 and 0.35 millimeter, the installation portion of the conductive terminal has an outer diameter between 0.6 and 0.65 millimeter, the inner stop edge of the body element has an inner diameter between 1.4 and 1.5 millimeter, the front opening of the body element has an inner diameter between 2.0 and 2.125 millimeter, a maximum distance between the front opening of the body element and the inner stop edge of the body element is 2.19 millimeter, and a distance between the front end of the contact portion of the conductive terminal and the inner stop edge of the body element is between 1.1 and 1.42 millimeter.

9. A coaxial connector for connection with a coaxial cable, the coaxial cable having a core, an inner insulative layer, a conductive layer, and an outer insulative layer arranged from an inside thereof to an outside thereof in order, the coaxial connector comprising:

an insulative sleeve having an aperture;

a connection member comprising a conductive structure having an inner surface;

the insulative sleeve being positioned in the connection member; and a conductive terminal having a positioning recess formed at a rear end thereof, the core of the coaxial cable being penetrated into the positioning recess and being soldered on the conductive terminal, the conductive terminal having a front end being penetrated through the aperture of the insulative sleeve to a front end of the connection member, the conductive layer of the coaxial cable being penetrated into the rear end of the connection member and being adjacent to the inner surface, and the conductive layer being soldered with the connection member, the conductive terminal further comprising a contact portion and an installation portion, the contact portion integrally extending from a front end of the installation portion, the installation portion having a through hole communicating to the positioning recess, a solder soldering the core of the coaxial cable in the positioning recess via the through hole, the installation portion having an outer stop edge disposed at a rear end thereof, the installation portion having an outer diameter accommodating to an inner diameter of the aperture of the insulative sleeve, the contact portion being located at the front end of the connection member, and the outer stop edge being blocked outside the aperture.

10. A coaxial connector for connection with a coaxial cable, the coaxial cable having a core, an inner insulative layer, a conductive layer, and an outer insulative layer arranged from an inside thereof to an outside thereof in order, the coaxial connector comprising:

an insulative sleeve having an aperture;

a connection member comprising a conductive structure having an inner surface;

the insulative sleeve being positioned in the connection member; and a conductive terminal having a positioning recess formed at a rear end thereof, the core of the coaxial cable being penetrated into the positioning recess and being soldered on the conductive terminal, the conductive terminal having a front end being penetrated through the aperture of the insulative sleeve to a front end of the connection member, the conductive layer of the coaxial cable being penetrated into the rear end of the connection member and being adjacent to the inner surface, and the conductive layer being soldered with the connection member;

wherein the rear end of the connection member and a corresponding adjacent distal end of the outer insulative layer of the coaxial cable are enveloped in a heat-shrinkable tube.

11. A coaxial connector for connection with a coaxial cable, the coaxial cable having a core, an inner insulative layer, a conductive layer, and an outer insulative layer arranged from an inside thereof to an outside thereof in order, the coaxial connector comprising:

an insulative sleeve having an aperture;

a connection member comprising a conductive structure having an inner surface;

the insulative sleeve being positioned in the connection member, the insulative sleeve having an annular groove formed on an outer circumferential surface thereof;

air provided in the annular groove thereby providing air between the insulative sleeve and the connection member;

a conductive terminal having a positioning recess formed at a rear end thereof, the core of the coaxial cable being penetrated into the positioning recess and being soldered on the conductive terminal, the conductive terminal having a front end being penetrated through the aperture of the insulative sleeve to a front end of the connection member, the conductive layer of the coaxial cable being penetrated into the rear end of the connection member and being adjacent to the inner surface, and the conductive layer being soldered with the connection member.

12. The coaxial connector as claimed in claim 11, wherein the insulative sleeve has a concavity formed at a rear end thereof, and air is provided in the concavity thereby providing air between the insulative sleeve and the conductive layer of the coaxial cable.

13. The coaxial connector as claimed in claim 11, wherein the conductive terminal is a male terminal.

14. The coaxial connector as claimed in claim 11, wherein the conductive terminal is a female terminal.

15. The coaxial connector as claimed in claim 11, wherein the connection member is one piece.

* * * * *